United States Patent [19]

Hermanson

[11] 4,114,634

[45] Sep. 19, 1978

[54] DISPOSABLE RAIN AND WEATHER PROTECTOR

[75] Inventor: Terry Hermanson, New York, N.Y.

[73] Assignee: Mr. Christmas Incorporated, New York, N.Y.

[21] Appl. No.: 835,752

[22] Filed: Sep. 22, 1977

Related U.S. Application Data

[63] Continuation-in-part of Ser. No. 699,638, Jun. 24, 1976, Pat. No. 4,062,369.

[51] Int. Cl.[2] ..... A45B 19/00

[52] U.S. Cl. ..... 135/19.5; 135/20 R

[58] Field of Search ..... 135/19.5, 20 R

[56] References Cited

U.S. PATENT DOCUMENTS

| | | | |
|---|---|---|---|
| 1,715,322 | 5/1929 | Foster | 135/19.5 |
| 1,783,972 | 12/1930 | Moses | 135/19.5 X |
| 4,062,369 | 12/1977 | Hermanson | 135/19.5 |

*Primary Examiner*—Werner H. Schroeder
*Assistant Examiner*—Conrad L. Berman
*Attorney, Agent, or Firm*—Karl W. Flocks

[57] ABSTRACT

This invention relates to a disposable umbrella and more particularly to a foldable umbrella fabricated of relatively rigid sheet material.

7 Claims, 14 Drawing Figures

FIG. 2.
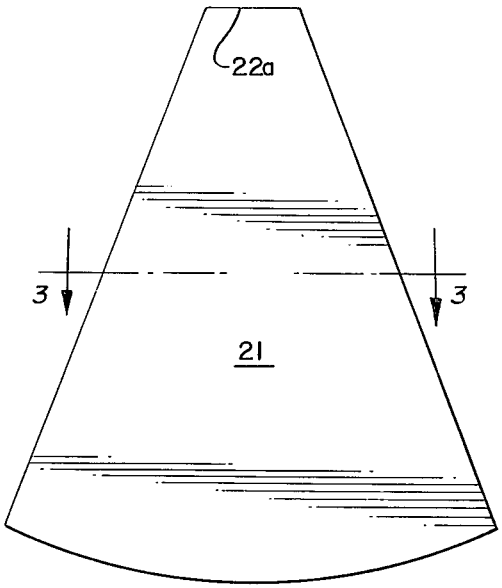
FIG. 4
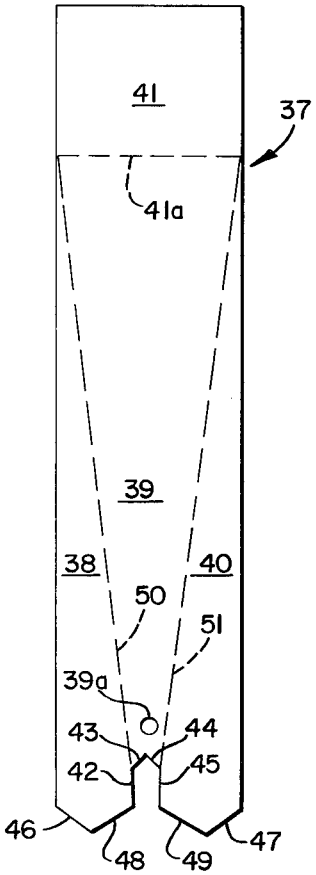
FIG. 5.
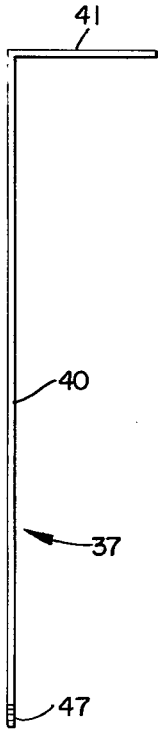
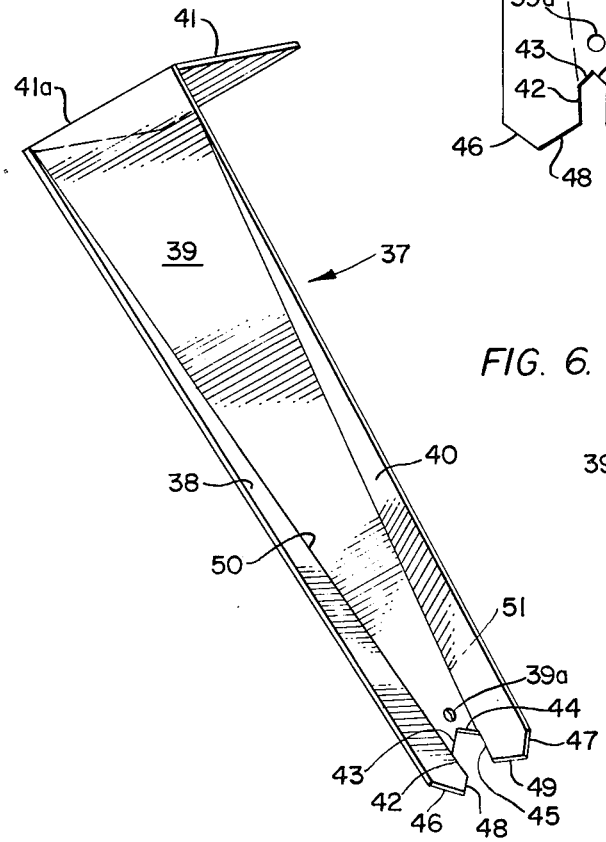
FIG. 6.
FIG. 14.
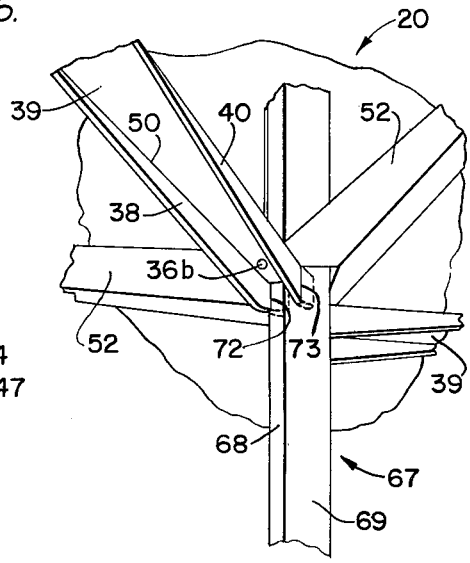

DISPOSABLE RAIN AND WEATHER PROTECTOR

This application is a continuation-in-part of copending application Ser. No. 699,638 filed June 24, 1976, now U.S. Pat. No. 4,062,369.

BACKGROUND OF THE INVENTION

Prior to the instant invention various constructions for disposable umbrellas have been attempted which have not been entirely satisfactory in that they are expensive to manufacture, cumbersome in utilization, and complex.

It is an object of the instant invention to provide a simple, foldable and disposable umbrella which is compact when folded, readily put into operating condition, and easy to manufacture and at low cost.

Other objects and the nature and advantages of the instant invention will be apparent from the following description taken in conjunction with the accompanying drawings, wherein:

BRIEF DESCRIPTION OF THE DRAWINGS

FIG. 2 is a top plan view of the umbrella in folded condition and illustrating the margins of the top major section;

FIG. 4 is a plan view of the blank of one of a first pair of canopy support elements which is adapted to be associated with one of a pair of major canopy sections;

FIG. 5 is a side elevational view of the canopy support element illustrated in FIG. 4 with a flap portion folded at right angles and adapted to be associated with a major canopy section.

FIG. 6 is a perspective view of the canopy support element illustrated in FIGS. 4 and 5 with portions thereof bent along fold lines to form a rigid channel structure;

FIG. 14 is a close-up view in perspective of the support structure when the umbrella is open.

THE CANOPY

Figure 1:
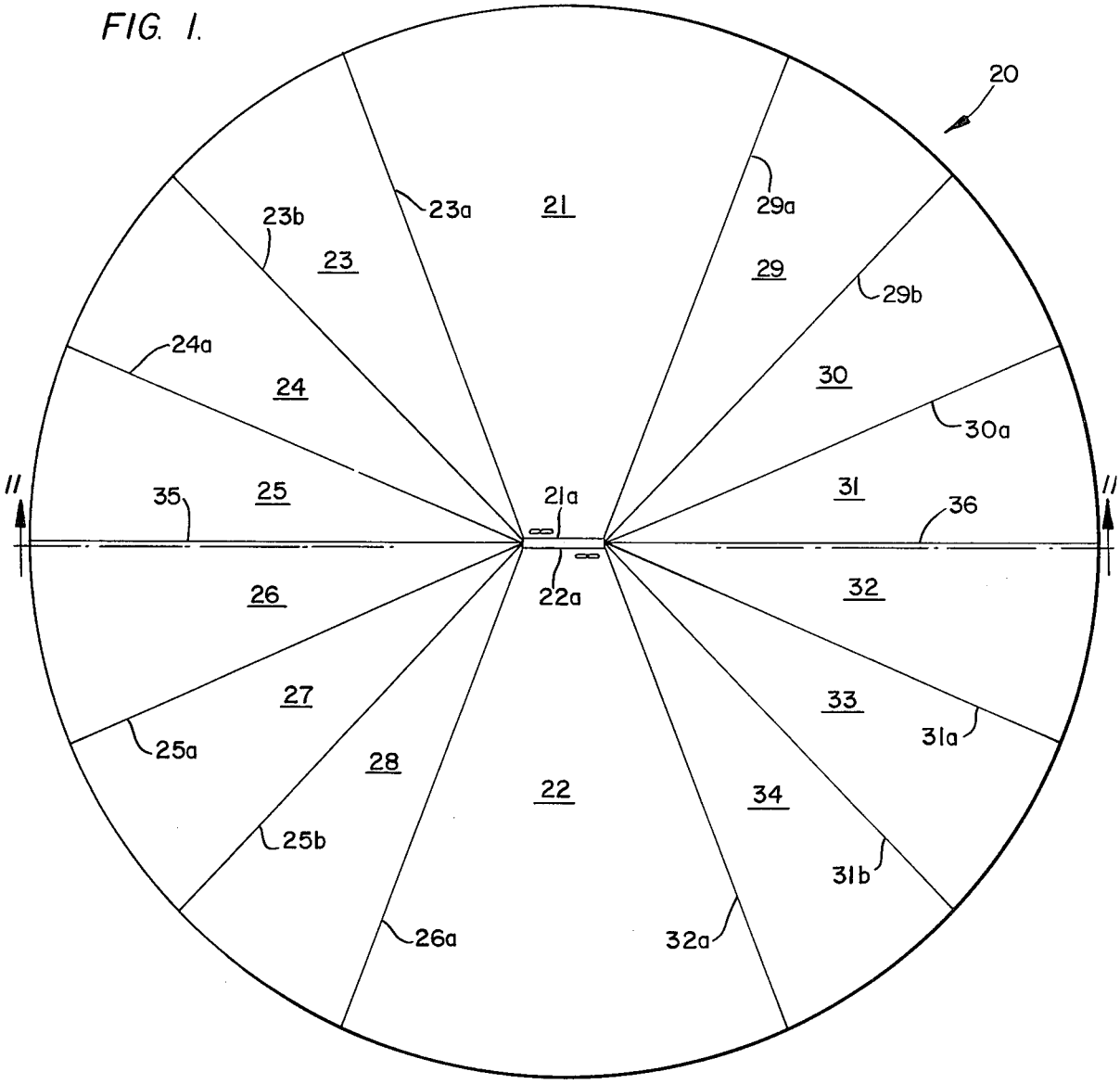
FIG. 1 is a top plan view of the umbrella canopy illustrating the fold lines thereof, the sectors forming the minor sections of the canopy, and the fold lines between the minor sections and the major sections of the canopy.

Referring to the drawings in detail, the canopy 20, as may be seen in FIG. 1, is generally circular in outline and is made up of foldably connected elements. The sections 21 and 22 are major canopy elements in the form of sectors from which segments have been removed near the junction of projected radii. These two major canopy elements 21 and 22 are not connected to each other except indirectly through the minor canopy elements comprising sectors 23, 24, 25, 26, 27, 28 and 29, 30, 31, 32, 33, 34. Each sector of the minor elements is in the form of a geometrical figure bounded by two radii and the included arc of a circle. Each sector of the minor elements is foldably connected to an adjacent sector. The marginal sectors 23, 29, 28, 34 of each of the minor elements is foldably connected to one side of a major canopy element 21 or 22. Starting from the right edge of major canopy element 21 and proceeding clockwise are fold lines **29*a*, 29*b*, 30*a*, 36, 31*a*, 31*b*, 32*a*, 26*a*, 25*b*, 25*a*, 35, 24*a*, 23*b*, and 23*a*, which together define in succession the circumferential boundaries of minor canopy elements 29, 30, 31, 32, 33, and 34, major canopy element section 22, minor canopy elements 28, 27, 26, 25, 24, and 23 and major canopy element section 21**.

The chords of the sectors 23-34 of each minor element are of less dimension than one-half of the dimension of the chord of each major element 21, 22.

Foldable Canopy Support Structure

Referring to FIGS. 3 through 9, canopy 20 is shown to be assembled on a foldable support structure which comprises a first pair of opposed support elements 37 with selectively lock means, a pair of auxiliary supporting structural elements 52, and a canopy pole or column 67. The support elements 37 are each generally U-shaped in section, each formed from a flat blank, as illustrated in FIG. 4, including fold lines 50 and 51 which separate the base portion 39 from the leg portions 38 and 40. Fold line **41*a* separates the base portion 39 from the flap portion 41 which is adapted to be secured to each of the two major canopy sections 21 and 22**.

The end of the elements 37 opposite to the flap end 41 is bifurcated to provide two locking formations one of which is bounded by the margins 43, 42, 48, 46 and the other of which by the margins 44, 45, 49 and 47. These locking formations cooperate with lock-engaging sockets or slots 72, 73 in the canopy pole or column 67 as will be later described. The base 39 of each of the first pair of opposed support structure elements is pierced at **39*a* for the purpose of pivotally connecting same to a second pair of opposed structure elements as will be later described. FIG. 6 illustrates one of the first pair of opposed support structure elements with the legs 38 and 40** in supporting position to provide rigidity and strength to the canopy support structure.

Figure 3:
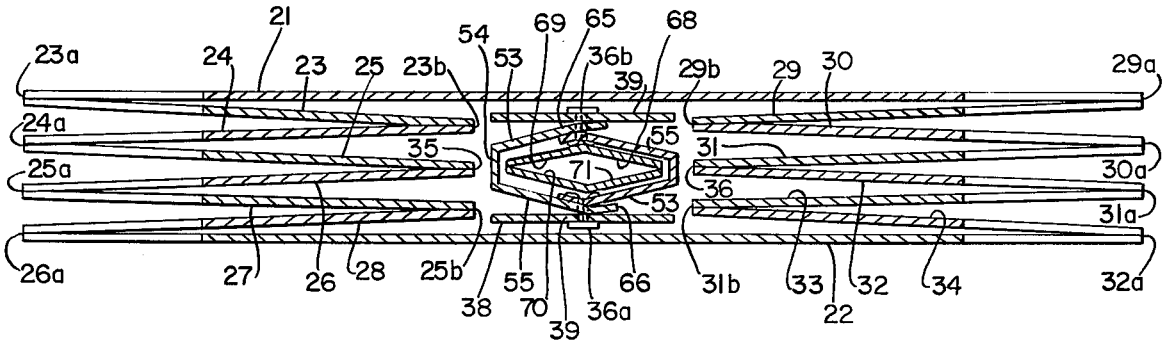
FIG. 3 is a section taken along line 3—3 of FIG. 2 and looking in the direction of the arrows and illustrating the various fold lines of the canopy, the canopy support structure, and the umbrella pole or column which serves as a handle.
Figure 11:
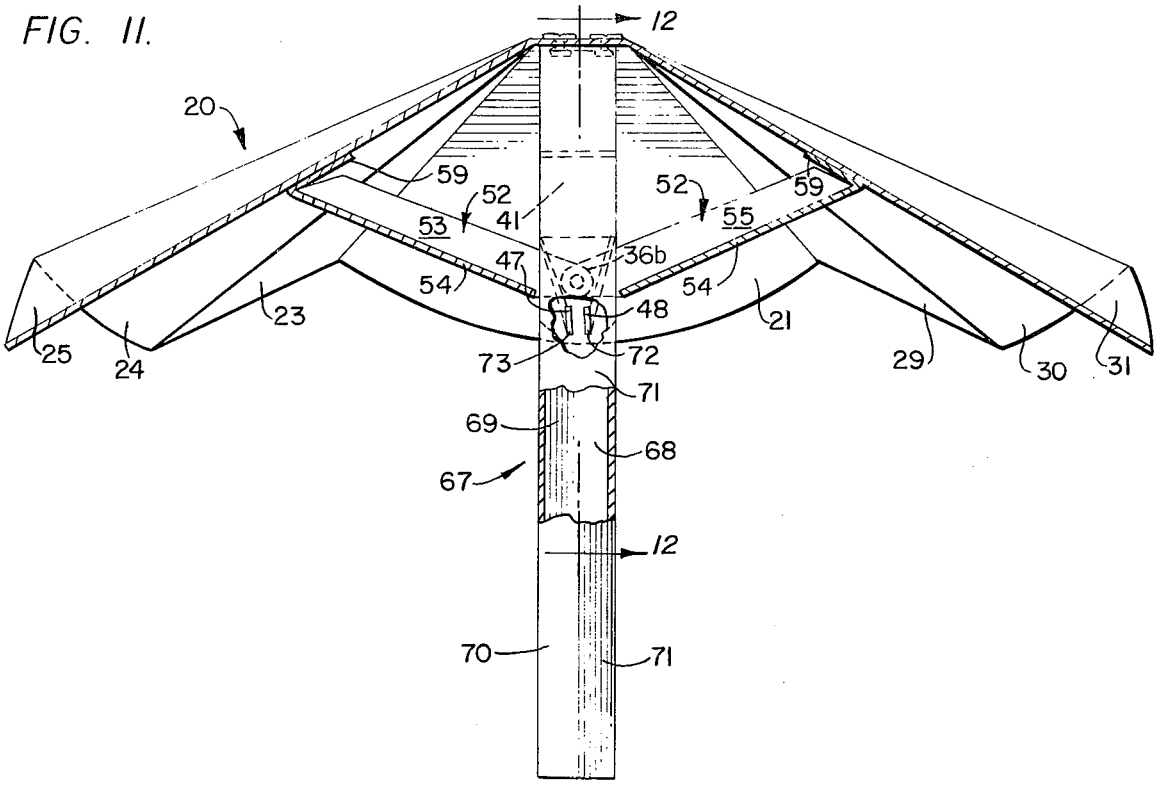
FIG. 11 is an elevational view of the umbrella, according to the present invention, in open condition for use, but with portions omitted to better illustrate certain details.
Figure 12:
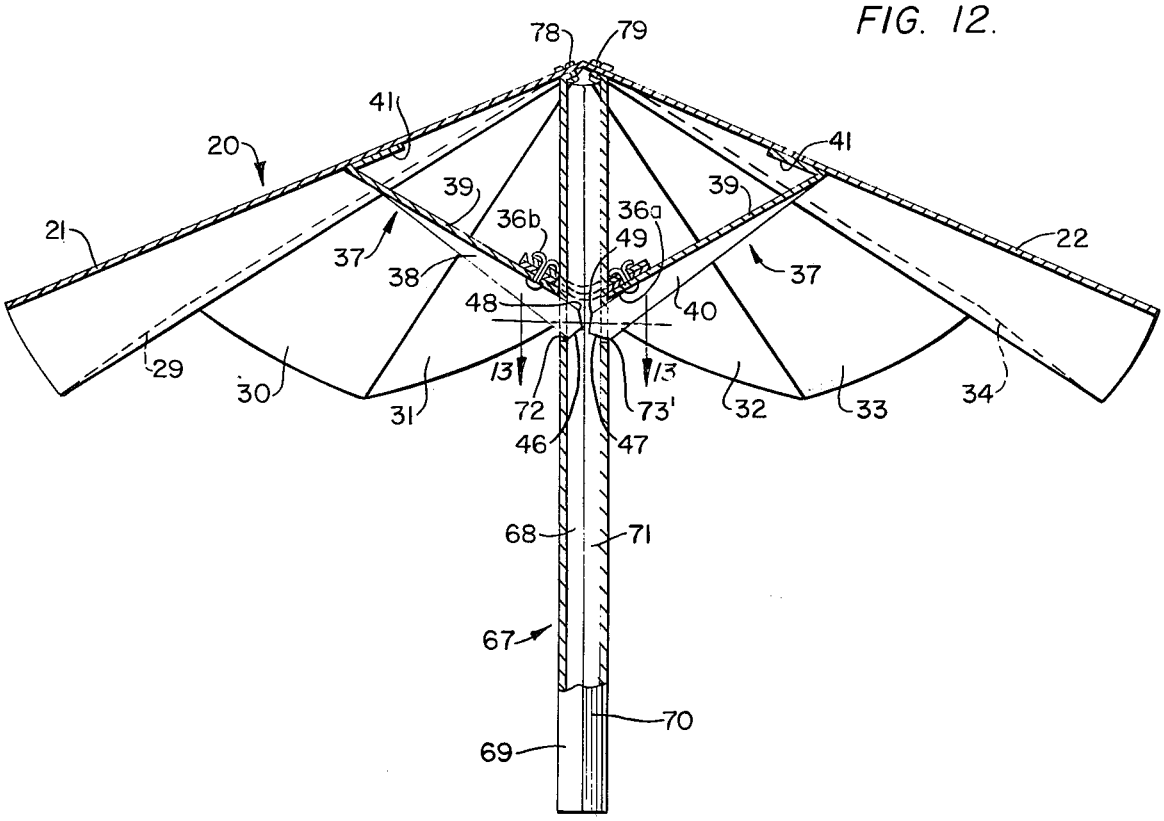
FIG. 12 is a sectional view taken along lines 12—12 in FIG. 11.
Figure 7:
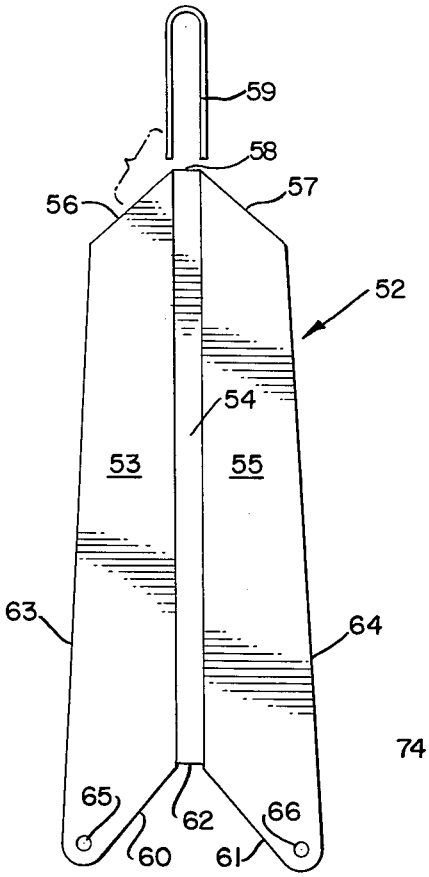
FIG. 7 is a plan view the blank of one of a second pair of canopy support elements with hinge formation extension at an upper end thereof adapted to be flexibly connected to an inward fold of canopy minor sections.
Figure 8:
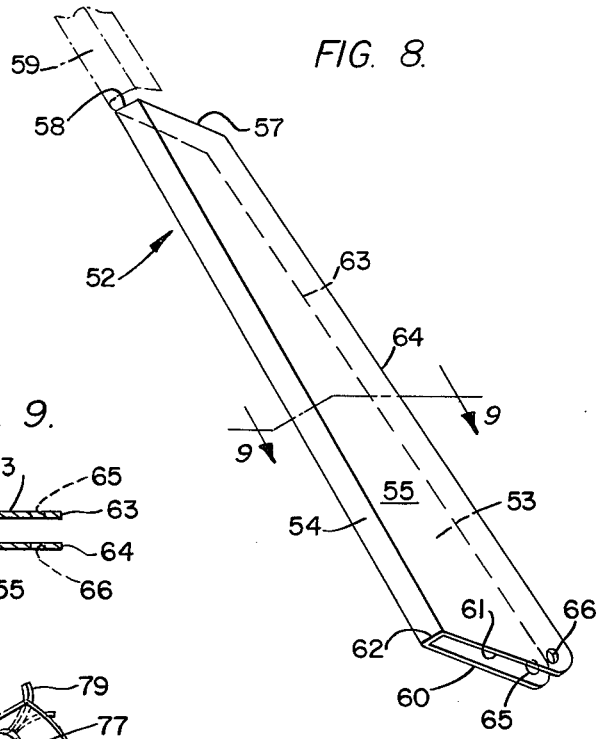
FIG. 8 is a view in perspective of the canopy support element illustrated in FIG. 7.
Figure 9:
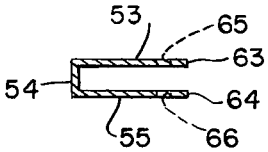
FIG. 9 is a sectional view of the element illustrated in FIG. 8 taken along line 9—9 and looking in the direction of the arrows.

One of the second pair of opposed supporting structural elements 52 is illustrated as a flat blank in FIG. 7 and in generally U-shaped structurally supporting channel formation in FIGS. 8 and 9. Each of the two elements 52 comprises a base portion 54 and two side portions 53 and 55. The side portion 53 is bounded by the margins 56, 63 and 60 and the side portion 55 is bounded by the margins 56, 64 and 61. The base portion 54 includes a top margin 58 from which extends a connector hinge 59 adapted to be secured to an inwardly extending fold line separating two minor sectors. One of the structural supporting elements 52 is flexibly connected to the canopy along the inwardly extending fold line 35 and the other element 52 of the second pair of supporting structural elements is flexibly connected by the hinge extension 59 to the inwardly extending canopy fold line 36. The opposite end of each of the two elements 52 is pierced at 65 and 66 so that the elements 52 may be connected to each other and to the elements 37 as illustrated in FIGS. 3 and 12 in such fashion that the elements 52 surround the umbrella pole or column in slidable relation. This connection is made with fasteners or pins 36*a* and 36*b* as illustrated in FIGS. 3, 12, and 14.

In the folded condition of canopy 20 major canopy element sections 21, 22 enclose therebetween minor canopy elements 23-38 and 29-34, as may also be seen in FIG. 3, with fold lines or edges 23*b*, 35, 25*b*, 29*b*, 36 and 31*b* extending internally between major canopy element sections 21 and 22 and with fold lines or edges 24*a* and 25*a* extending adjacent to exposed fold lines or edges 23*a* and 26*a* and with fold lines or edges 30*a* and 31*a* extending adjacent to exposed fold lines or edges 29*a* and 32*a*.

Collapsible Canopy Pole or Column

Figure 10:
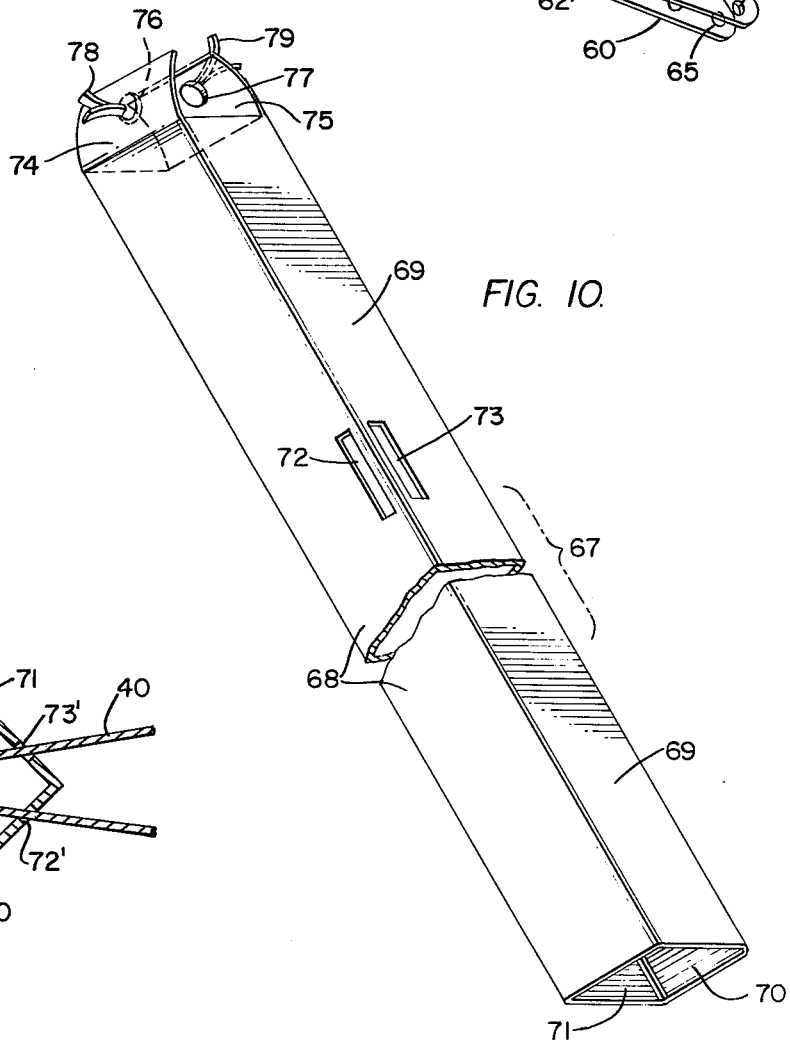
FIG. 10 is a view in perspective of the umbrella pole or column which serves as a handle.
Figure 13:
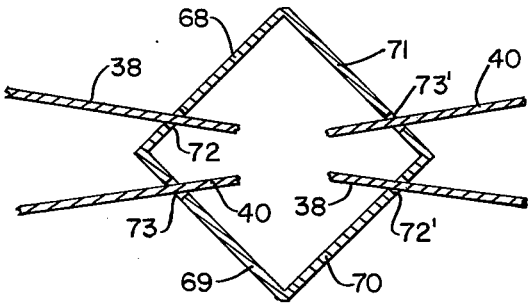
FIG. 13 is a sectional view taken along line 13—13 in FIG. 12.

Referring to FIG. 10 the collapsible canopy pole or column 67 is made in the form of a hollow column of square or rectilinear or parallelogram section comprising faces 68, 69, 70 and 71. The face 69 is formed with an extension 74 pierced at 76 so that it may be secured by fastener 78 to one of the major canopy sections 21. The face 71 is formed at its upper end with an extension 75 pierced at 77 so that it may be connected by fastener 79 to the inner face of the other major canopy section 22 in similar manner. The extensions 74 and 75 are foldably connected to the major canopy sections 21 and 22 near the margins 21*a* and 22*a* of the major canopy sections 21 and 22. The faces 68 and 69 are provided with slots 72 and 73 and the faces 70 and 71 are provided with similar slots 72' and 73', as may be seen in FIGS. 10 and 13, which act as lock engaging formations to receive the bifurcated ends of the canopy support structure elements 37 in the erected condition of canopy 20 illustrated in FIGS. 11–14.

Operation of the Foldable Umbrella

When in folded condition, the umbrella appears as shown in the plan view of FIG. 2 and in the cross section of FIG. 3. The size of the folded umbrella is essentially the size of one major section of the canopy. As will be seen from FIG. 3 the minor sectors 23-34 of the canopy 20 are entirely disposed within the projections of the major canopy sections 21 and 22 and extend inwardly to a dimension less than one-half the width of the major canopy sections 21, 22 so that space is provided for the collapsible canopy supporting structure and the collapsible umbrella pole or column 67.

By pulling the major canopy sections 21 and 22 apart slightly and then by grasping the umbrella pole or column 67 with one hand and pushing upwardly on the canopy supporting structure, namely elements 37 and 52, the canopy 20 will open more fully as the minor sectors 23-34 assume an unfolded position. When this movement of the canopy supporting structure is continued and the two opposed pairs of canopy support structure elements 37 and 52 assume their channel-like formation, a rigid and strong support for the canopy 20 is provided. With the umbrella in fully open position, the bifurcated lower ends of the elements 37 are inserted in the slots 72 and 73 in the column 67 to lock the canopy in fully open position.

When it is desired to close the umbrella, the bifurcated ends of the elements 37 are withdrawn from the slots 72 and 73, the major sections 21 and 22 are brought together, and the minor sectors 23-34 will then assume their folded accordian position as illustrated in FIG. 3. The canopy supporting structure elements 37 will assume a flat condition as illustrated in FIG. 3. The collapsible canopy pole or column 67 will collapse as will the canopy support elements 52 assume a position in which the side portions 53 and 55 are closer together.

Thus it will be understood that when in closed position the umbrella is entirely collapsed, the canopy 20 is collapsed to a near flat condition, the canopy support pole or column 67 is flattened, the canopy supporting elements 37 are flattened, and each canopy supporting element 52 has its side portions 53 and 55 brought together. In this flattened condition, the canopy supporting structure and the canopy pole or column 67 are located between the inner faces of the major canopy sections 21 and 22 and between the inwardly extending fold lines 23*b*, 35, and 25*b* of the minor canopy sectors 23-28 and inwardly extending fold lines 29*b* 36 and 31*b* of minor sectors 29-34.

It is to be understood that the entire structure of the disposable and foldable umbrella according to the present invention may be made of flat sheet material such as corrugated board or equivalent inexpensive material. When corrugated board is utilized the channels or corrugations should have their axes run longitudinally and generally parallel to the longer dimension of said elements.

It will be obvious to those skilled in the art that various changes may be made without departing from the scope of the invention and the invention is not to be considered limited to what is shown in the drawings and described in the specification.

What is claimed is:

1. A disposable umbrella comprising a foldable canopy, foldable canopy support structure, and a collapsible canopy pole or column, said canopy including a pair of opposed major sections and a pair of opposed minor sections each major section being of relatively rigid sheet material having an inner face and an outer face and in the general shape of a sector of a circle from which a segment has been removed near the projected junction of two radii, each minor section including at least two portions each of which is generally in the shape of a sector of a circle and inwardly foldably connected to each other, each major section being foldably connected on each of two sides to a side of a minor section, the chords of the portions of each minor section being of less than one-half of the dimension of the chord of each major section whereby, when the umbrella is folded, the canopy support structure and the canopy pole or column lie between the inward margins of folded minor sections and between the inner faces of the opposed major sections.

2. A disposable umbrella in accordance with claim 1 wherein said canopy support structure is foldably connected to the inner faces of said canopy major sections and inward margins of said minor section.

3. A disposable umbrella in accordance with claim 1 wherein the foldable support structure comprises a first pair of opposed elements of generally "U" shaped section each formed from a flat blank with at least two fold lines and a second pair of opposed elements of generally "U" shaped section each formed from a flat blank with at least two fold lines.

4. A disposable umbrella in accordance with claim 3 wherein said first pair of opposed support structure elements includes portions which taken together surround said canopy pole or column.

5. A disposable umbrella in accordance with claim 3, wherein said second pair of opposed elements of said foldable support structure is formed with lock engaging structure for engaging lock formations provided in said canopy pole or column.

6. A disposable umbrella in accordance with claim 1 wherein said canopy pole or column is hollow and collapsible and formed from a flat blank with a plurality of fold lines extending in a direction parallel to the axis of the pole or column forming discrete faces of said pole or column.

7. A disposable umbrella in accordance with claim 6 wherein at least two faces of said canopy pole or column are provided with lock engaging formations.

* * * * *